US012262779B2

(12) United States Patent
Kajiwara et al.

(10) Patent No.: US 12,262,779 B2
(45) Date of Patent: Apr. 1, 2025

(54) SOLE FOR A SHOE

(71) Applicant: MIZUNO Corporation, Osaka (JP)

(72) Inventors: Yo Kajiwara, Osaka (JP); Yohei Yoshida, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 38 days.

(21) Appl. No.: 18/083,679

(22) Filed: Dec. 19, 2022

(65) Prior Publication Data

US 2023/0200486 A1 Jun. 29, 2023

(30) Foreign Application Priority Data

Dec. 27, 2021 (JP) ..... 2021-212124

(51) Int. Cl.
*A43B 13/14* (2006.01)

(52) U.S. Cl.
CPC ..... *A43B 13/145* (2013.01); *A43B 13/146* (2013.01)

(58) Field of Classification Search
CPC ... A43B 13/125; A43B 13/127; A43B 13/145; A43B 13/146
See application file for complete search history.

(56) References Cited

U.S. PATENT DOCUMENTS 6,857,205 B1 * 2/2005 Fusco ..... A43B 13/141 36/31
9,289,028 B1 * 3/2016 Anderson ..... A43B 7/148
2009/0077830 A1 * 3/2009 Lee ..... A43B 13/12 36/108
2010/0146825 A1 * 6/2010 Teteriatnikov ..... A43B 13/145 36/30 R
2010/0307028 A1 * 12/2010 Teteriatnikov ..... A43B 13/145 36/108
2011/0078923 A1 * 4/2011 Bartholet ..... A43B 13/145 36/92
2012/0060391 A1 * 3/2012 Hong ..... A43B 7/084 36/31
2012/0317835 A1 * 12/2012 Raysse ..... A43B 13/145 36/31
2016/0345668 A1 * 12/2016 Dyer ..... A43B 13/186
2020/0245717 A1 * 8/2020 Fusco ..... A43B 13/026
2020/0305543 A1 * 10/2020 Kajiwara ..... A43B 13/023
2022/0031016 A1 * 2/2022 Geis ..... A43B 13/141

FOREIGN PATENT DOCUMENTS

JP H10234412 A 9/1998
JP 2020163084 A 10/2020

* cited by examiner

*Primary Examiner* — Sharon M Prange
(74) *Attorney, Agent, or Firm* — CANTOR COLBURN LLP

(57) ABSTRACT

A sole reference posture is determined such that a straight reference line connects a toe-tip position and a rearmost end position of a sole top surface, a path length measured along the sole top surface from the origin of the rearmost end position to the toe-tip position is L, an intersection point of a sole bottom surface and a line crossing a position of 0.45×L and orthogonal to the reference line is position C, and the sole is in contact with the ground at position C. In the reference posture, the sole bottom surface is separated from the ground at a heel portion and a toe portion, and an inequality θ≥5 is satisfied, wherein θ is an angle between a straight line connecting a heel central position of 0.15×L with a metatarsophalangeal joints position of 0.68×L and the ground.

4 Claims, 19 Drawing Sheets

SOLE FOR A SHOE

BACKGROUND OF THE INVENTION

The present invention relates generally to a sole for a shoe, and more particularly, to an improved structure of a sole that can not only naturally urge and sustain a forefoot running style during running but also enhance a running efficiency during forefoot running.

Recently, when running efficiently in a long-distance race, a forefoot running style that impacts the ground at the forefoot region has become mainstream. The forefoot running style has merits that it can reduce the burden on a knee and shorten a contact time to ease the burden on muscles. It is considered that an efficient movement can be attained and a superior running economy can be achieved by skillfully utilizing springy behaviors of an Achilles tendon and calf muscles, i.e. expansion/contraction of the Achilles tendon and contraction/relaxation of the calf muscles, during the forefoot running. Here, the term, "running economy" is an index showing how one can run at a certain speed zone with less energy (or less oxygen consumption). As the running economy is superior or high, the oxygen consumption is small and thus an efficient running can be achieved.

However, it requires not less than a certain degree of skill to acquire a forefoot running. Specifically, firstly, a contact skill is necessary to allow for a forefoot/midfoot contact with the ground in a phase immediately before a ground contact. Secondly, a leg strength (or muscular strength and endurance) is necessary to restrain a falling (or sinking/dropping) of a heel to withstand stretching of tendon of muscles in a phase of a ground contact. Finally, a lock of an ankle is necessary. Therefore, it was not easy for a beginner runner to acquire the forefoot running. It mostly depended on an ability of a runner whether he/she can perform the forefoot running continuously.

Incidentally, a sole with a high-rigidity plate (e.g. CFRP (carbon fiber reinforced plastic) plate) incorporated therein has been provided for a practical use in order to support a heel during sinking of the heel. In such a sole, when a load is transferred to a forefoot portion, a forefoot area of the plate is pushed downwardly and thus a heel area of the plate is lifted upwardly through a seesaw action, thereby supporting the heel.

However, since the sole incorporating such a plate is not so structured as to urge a forefoot running naturally as a single piece of sole, it was not sufficient for causing the forefoot running to be sustainable.

Japanese patent application publication No. 2020-163084 discloses a sole for a shoe to achieve a forefoot running (see paragraphs [0020] to [0024], [0028] to [0030] and FIG. 9). In the sole, inequalities, m2≥m1, m1≥f and m1≥h are satisfied, wherein a position of a rearmost end of a foot-sole-contact-side surface is the origin of a coordinate, a path length measured along the foot-sole-contact-side surface from the origin to a position of a tip of the toe is L, in the state that the foot-sole-contact-side surface at a heel region is arranged parallel to a horizontal plane, a sole thickness at a position Sh of a distance of 0.16×L away from the origin is h, a sole thickness at a position Sm2 of a distance of (0.3-0.5)×L away from the origin is m2, a sole thickness at a position Sm1 of a distance of (0.4-0.6)×L away from the origin is m1 provided that the position Sm1 is disposed in front of the position Sm2, and a sole thickness at a position Sf of a distance of 0.7×L away from the origin is f. Also, an inequality, θ2≥θ1 is satisfied, wherein an angle between a line connecting the positions Sm1 and Sh and the horizontal plane is θ1, a position where a vertical line drawn from the position Sm1 crosses a ground-contact surface is Sm1', a position where a vertical line drawn from the position Sh crosses the ground-contact surface is Sh', and an angle between a line connecting the positions Sm1' and Sh' and the horizontal plane is θ2. Furthermore, the ground-contact surface has a downwardly convexly curved shape at a forefoot region.

According to the sole described in the above-mentioned publication, the sole thickness h at the position of 0.16×L from the origin is smaller than the sole thickness m1 at the position of (0.4-0.6)×L from the origin, and besides, the angle θ2 between the line connecting the positions Sm1' and Sh' and the horizontal plane is greater than the angle θ1 between the line connecting the positions Sm1 and Sh and the horizontal plane. Thereby, at the time of striking onto the ground, a heel portion does not contact the ground without causing a heel strike, thus promoting a forefoot contact with the ground on landing. Also, the sole thickness m2 at the position of Sm2 is greater than the sole thickness m1 at the position of Sm1, such that thereby when an initial contact with the ground occurs at the position Sm1' on a sole ground-contact surface, the sole is prevented from leaning rearwardly and thus the heel is restricted from sinking downwardly, thus promptly moving onto a forward rolling of the sole after the initial contact with the ground. Furthermore, the sole thickness f at the position of 0.7×L from the origin is smaller than the sole thickness m1 at the position Sm1, and besides, the sole ground-contact surface has a downwardly convexly curved shape at the forefoot portion, thereby achieving a smooth forward rolling of the sole.

Through further intensive studies of a sole for achieving a forefoot running, in order to naturally urge a forefoot running during running and to cause the forefoot running to be sustainable, inventors of the present application have found that there are rooms for further improvement in the above-mentioned sole.

The present invention has been made in view of these circumstances and its object is to provide a sole for a shoe that can not only naturally urge and sustain a forefoot running during running but also enhance a running efficiency during forefoot running.

Other objects and advantages of the present invention will be obvious and appear hereinafter.

SUMMARY OF THE INVENTION

A sole for a shoe according to the present invention extends from a heel portion to a toe portion and has a sole upper surface and a sole lower surface. A sole reference posture is defined, wherein a reference line S is set as a straight line to connect a toe-tip position and a rearmost end position of the sole upper surface, the rearmost end position is set to the origin O, a path length measured along the sole upper surface from the origin O to the toe-tip position is set to L, an intersection point of the sole lower surface and a line crossing a position of (0.45×L) from the origin O along the sole upper surface and orthogonal to the reference line S is set to a ground-contact point C, and the sole is in contact with the ground at the ground-contact point C. In the sole reference posture, the sole lower surface is separated from the ground at the heel portion and the toe portion. Also, in the sole reference posture, an angle θ is greater than or equal to 5 degrees, in which the angle θ is set between the ground and a straight line connecting a heel central position of (0.15×L) along the sole upper surface from the origin O with a metatarsophalangeal joints position of (0.68×L) along the sole upper surface from the origin O.

According to the present invention, in the sole reference posture in which the sole is in contact with the ground at the point C corresponding to the position of (0.45×L) from the origin O, since the sole bottom surface at the heel portion and the toe-tip position is separated (and thus, floated) from the ground, an intentional ground contact of the heel portion is prevented, thereby enabling a natural forefoot running to be promoted and sustainable, thus achieving a smooth shift in center of gravity toward the toe portion from the heel portion. Also, a sole ground contact occurs at the point C of (0.45×L) from the origin O in front of a foot ankle, such that thereby springy behaviors of tendons can be performed and a load can be lessened to improve a running efficiency.

Furthermore, according to the present invention, in the sole reference posture, the angle θ is greater than or equal to 5 degrees, in which the angle θ is set between the ground and the straight line connecting the heel central position of (0.15×L) along the sole upper surface from the origin O with the metatarsophalangeal joints position of (0.68×L) along the sole upper surface from the origin O, such that thereby the heel portion is disposed above the forefoot portion of the sole (that is, put at a heel-up state), thus matching it with a forefoot posture. In such a manner, a natural support effect by the sole bottom surface can be developed from the moment of the ground contact, an excessive sinking of the heel portion at the time of the ground contact can be prevented, and a smooth transfer from the heel portion to the forefoot portion after the ground contact can be conducted.

Additionally, in the event that there is a concave portion, a groove or the like formed at a position corresponding to the point C on the sole bottom surface, a virtual surface that smoothly connect longitudinally opposite opening ends of the concave portion, groove or the like is set as a virtual sole bottom surface and the point C is determined on the virtual sole bottom surface.

Here, if the sole reference posture according to the present invention is applied to the sole shown in the above-mentioned patent application publication No. 2020-163084, the point C may be located at the position near the heel portion and in that case the heel portion sinks downwardly to cause a backward tilted posture. At this time, a ground contact on the heel side other than the foot ankle is likely to occur, and as a result, springy behaviors of tendons cannot be performed thus rendering a forefoot running unachievable. Also, regarding the angle θ, because the sole is in the backward tilted posture, an inequality, θ≥5 [degrees] cannot be satisfied.

In the sole reference posture, the sole lower surface may be separated from the ground in a rear side region from the heel central position at the position of (0.15×L) from the origin O along the sole upper surface and in a foreside region from the metatarsophalangeal joints position at the position of (0.68×L) from the origin O along the sole upper surface.

A compressive rigidity at the metatarsophalangeal joints position may be lower than a compressive rigidity at the heel portion. Thereby, an excessive sinking of the heel portion of the sole can be prevented and a weight shift toward the metatarsophalangeal joints position can be facilitated. Here, the term, "compressive rigidity" is a concept that expresses a resistance to deformation relative to a compressive load. When the same compressive load is applied, a sole of a high compressive rigidity undergoes a small amount of deformation, and a sole of a low compressive rigidity undergoes a large amount of deformation.

The curved plate extending continuously curvedly may be provided inside the sole. The curved plate may extend at least at the heel central position and the metatarsophalangeal joints position. Thereby, an energy loss due to sinking or dropping of the heel portion of the sole can be prevented from occurring and an elevation of the heel portion can be promoted during a load transfer to the toe portion, thus allowing for supporting a forward propulsion during running.

As mentioned above, according to the shoe sole of the present invention, a forefoot running can be naturally urged and made sustainable during running, and a running efficiency during forefoot running can be enhanced.

BRIEF DESCRIPTION OF THE DRAWINGS

For a more complete understanding of the invention, reference should be made to the embodiments illustrated in greater detail in the accompanying drawings and described below by way of examples of the invention.

DETAILED DESCRIPTION OF THE PREFERRED EMBODIMENTS

Figure 1:
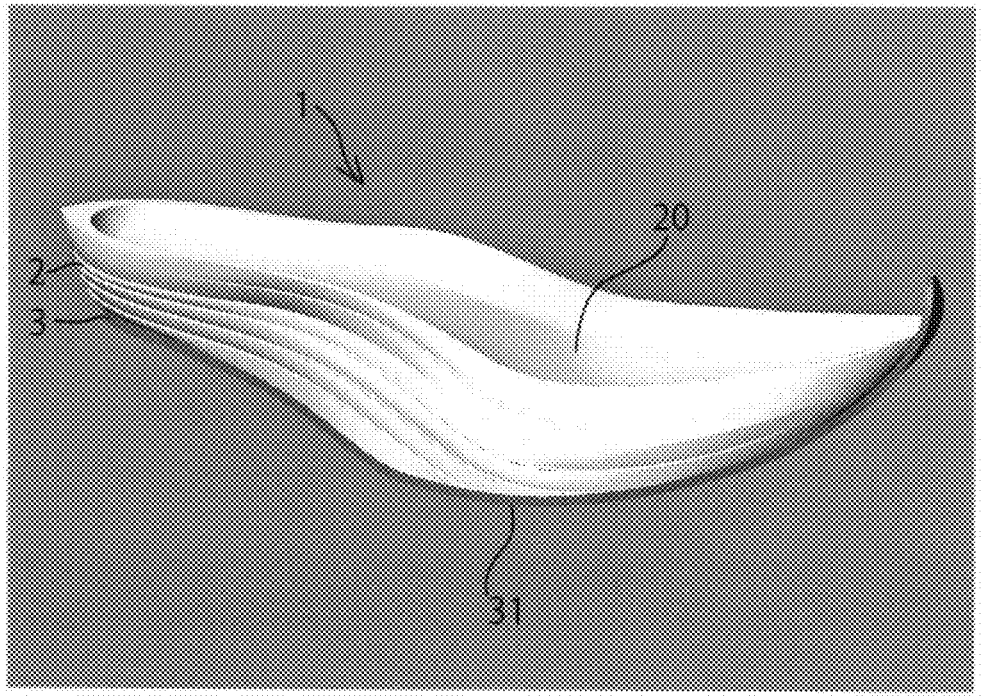
FIG. 1 is a general perspective view of a sole according to an embodiment of the present invention, as viewed from forwardly diagonally above.
Figure 2:
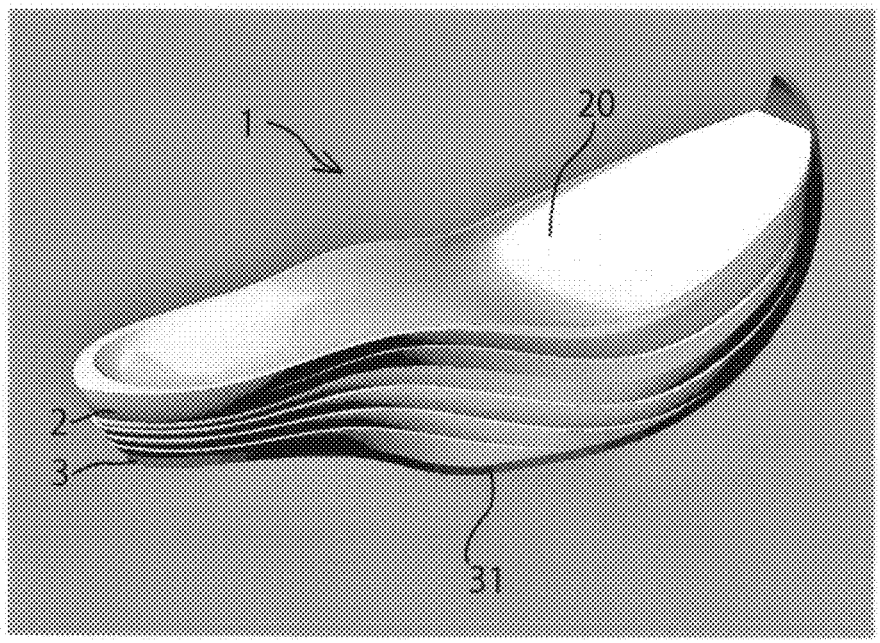
FIG. 2 is a general perspective view of the sole of FIG. 1, as viewed from rearwardly diagonally above.
Figure 3:
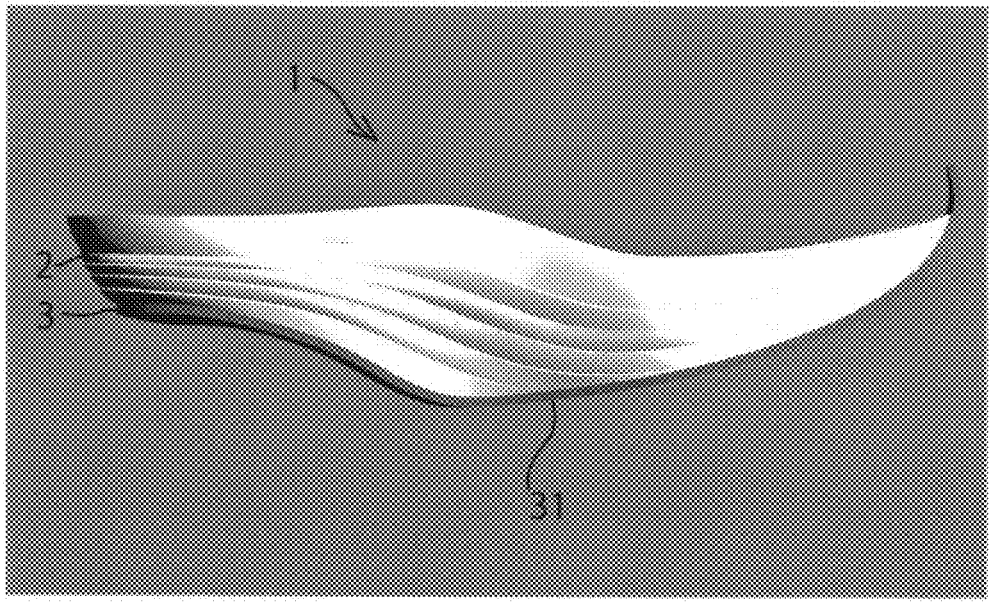
FIG. 3 is a side view of the sole of FIG. 1.
Figure 8:
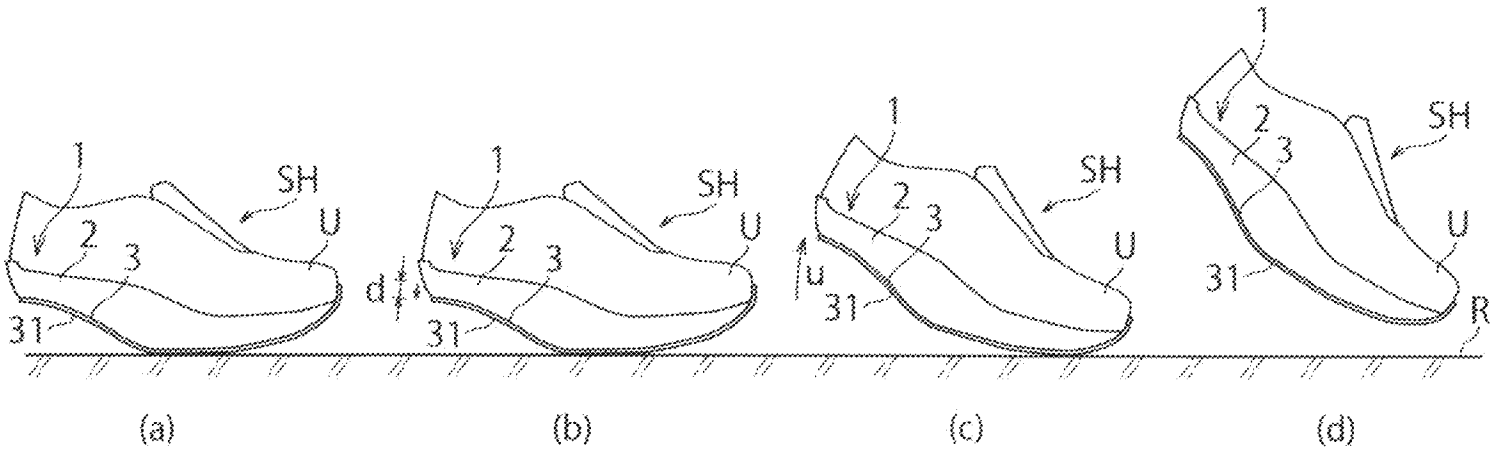
FIG. 8 shows the state of running of the shoe of FIG. 4, illustrating movements of the shoe relative to the ground in the order from (a) to (d) in time-series manner.
Figure 9:
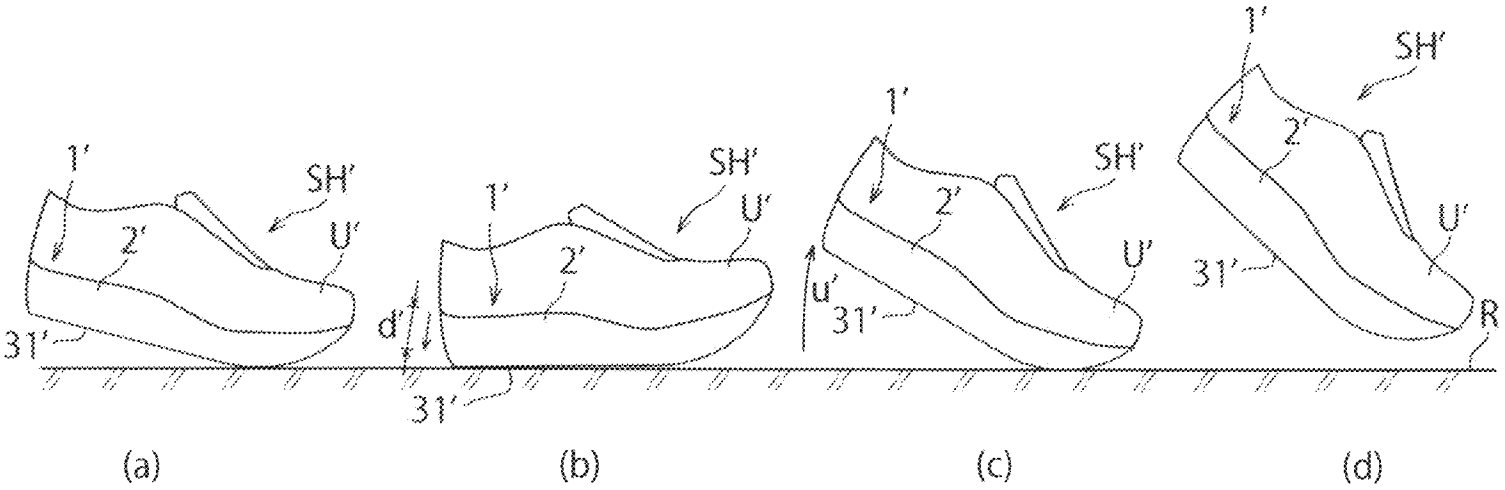
FIG. 9 shows the state of running of a conventional shoe, illustrating movements of the shoe relative to the ground in the order from (a) to (d) in time-series manner.

The present invention will now be described in detail with reference to embodiments thereof as illustrated in the accompanying drawings. FIGS. 1 to 9 show a sole of a shoe according to an embodiment of the present invention. In these drawings, FIGS. 1 to 3 show an external appearance of the shoe, FIGS. 4 to 7 show a side surface shape of the sole, FIG. 8 shows the state of running of the shoe in time-series manner, and FIG. 9 shows the state of running of a conventional shoe in time-series manner for comparison with FIG. 8. Additionally, in FIGS. 1 to 3, a background is colored in gray for illustration purposes. Here, a sports shoe, especially a running shoe for a middle distance is taken for an example as a shoe.

In the following explanations, "upward (upper side/upper)" and "downward (lower side/lower)" designate an upward direction and a downward direction, or vertical direction, of the shoe, respectively, "forward (front side/front)" and "rearward (rear side/rear)" designate a forward direction and a rearward direction, or longitudinal direction, of the shoe, respectively, and "a width or lateral direction" designates a crosswise direction of the shoe.

Figure 4:
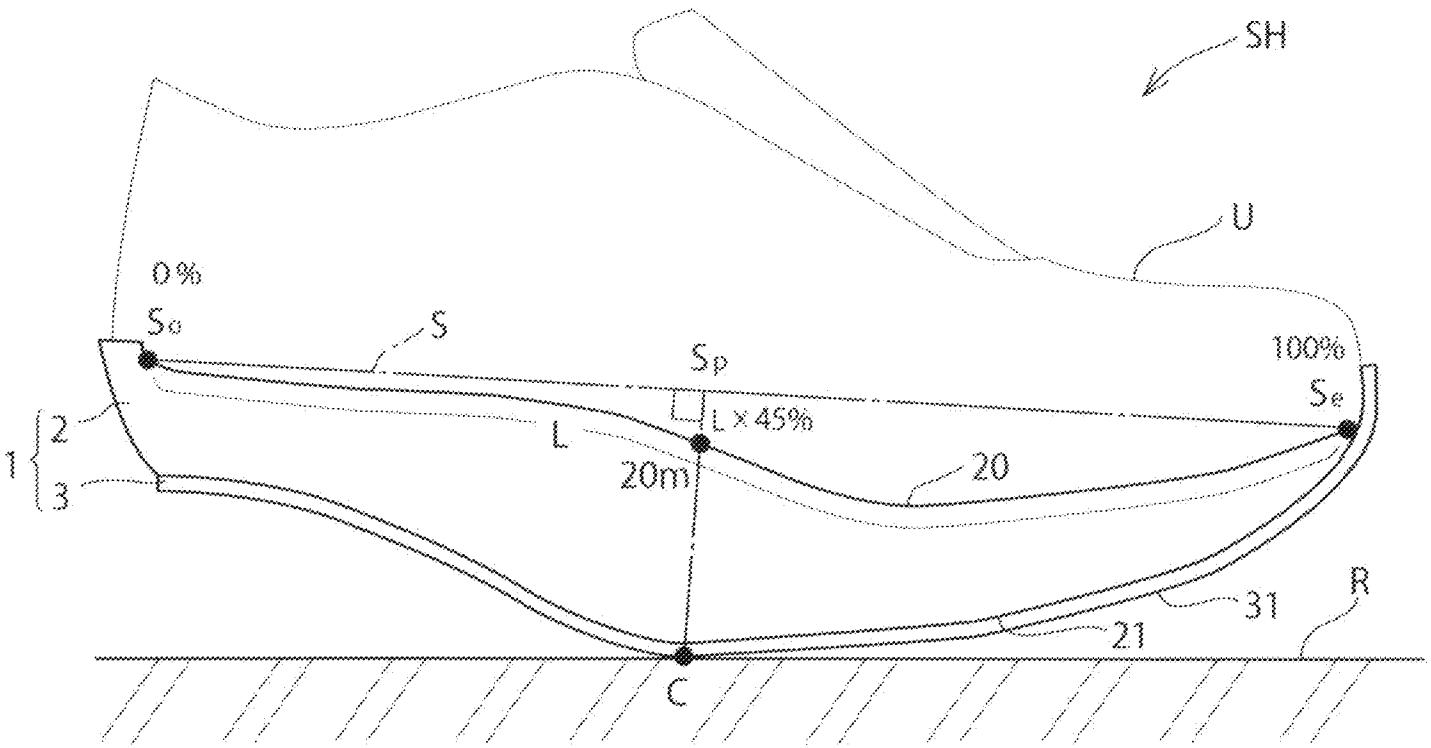
FIG. 4 is a side schematic view of a shoe employing the sole of FIG. 1.

For example, in FIG. 4, a side schematic view of the shoe, "upward" and "downward" designate "upward" and "downward" in FIG. 4 respectively, "forward" and "rearward" designate "right to left direction" in FIG. 4 and "a width direction" designates "out of the page" and "into the page" of FIG. 4.

As shown in FIGS. 1 to 3, Sole 1 includes a midsole 2 disposed on an upper side of the sole 1 and an outsole 3 disposed below the midsole 2. A top surface of the sole 1 (or sole top surface) is formed of a foot-sole-contact surface 20 of the midsole 2, and a bottom surface of the sole 1 (or sole bottom surface) is formed of a ground-contact surface 31 of the outsole 3.

As shown in FIG. 4, Shoe SH is so structured as to fixedly attach an upper U through bonding, sewing or the like to the top side of the sole 1. The outsole 3 of the sole 1 is fixedly attached to the bottom surface 21 of the midsole 2 via bonding, etc. The midsole 2 and the outsole 3 extend from a heel portion (i.e. a left end portion of FIG. 4) of the sole 1 to a toe portion (i.e. a right end portion of FIG. 4).

The midsole 2 is formed of a soft elastic material, more specifically, thermoplastic synthetic resin and its foamed resin such as ethylene-vinyl acetate copolymer (EVA) or the like, thermosetting synthetic resin and its foamed resin such as polyurethane (PU) or the like, alternatively, rubber material and foamed rubber such as butadiene rubber, chloroprene rubber or the like. The outsole 3 is formed of hard elastic materials, more specifically, thermoplastic resin such as thermoplastic polyurethane (TPU), polyamide elastomer (PAE) and the like, thermosetting resin such as epoxy resin and the like, or solid rubber.

As shown in FIG. 4, a reference line S is defined as a straight line that connects a toe-tip position Se and a rearmost end position (or heel rear end) $S_0$ of the sole upper surface 20. Here, the sole upper surface 20 coincides with a shape of a bottom surface of a last in use for assembly of the shoe SH. Then, the rearmost end position $S_0$ is set to the origin O, a path length measured along the sole upper surface 20 from the origin O to the toe-tip position Se is set to L, and an intersection point of the sole bottom surface 31 and a line crossing a position 20*m* of (0.45×L) from the origin O along the sole upper surface 20 and orthogonal to the reference line S is set to a position C. In FIG. 4, an intersection point of the reference line S and a line crossing the position 20*m* and orthogonal to the reference line S is set to Sp. When a reference posture is defined as a sole posture in which the sole 1 is in contact with the ground R at the point C, the sole bottom surface 31 at the heel portion and the toe portion is separated (or floated) from the ground R in the reference posture.

Figure 5:
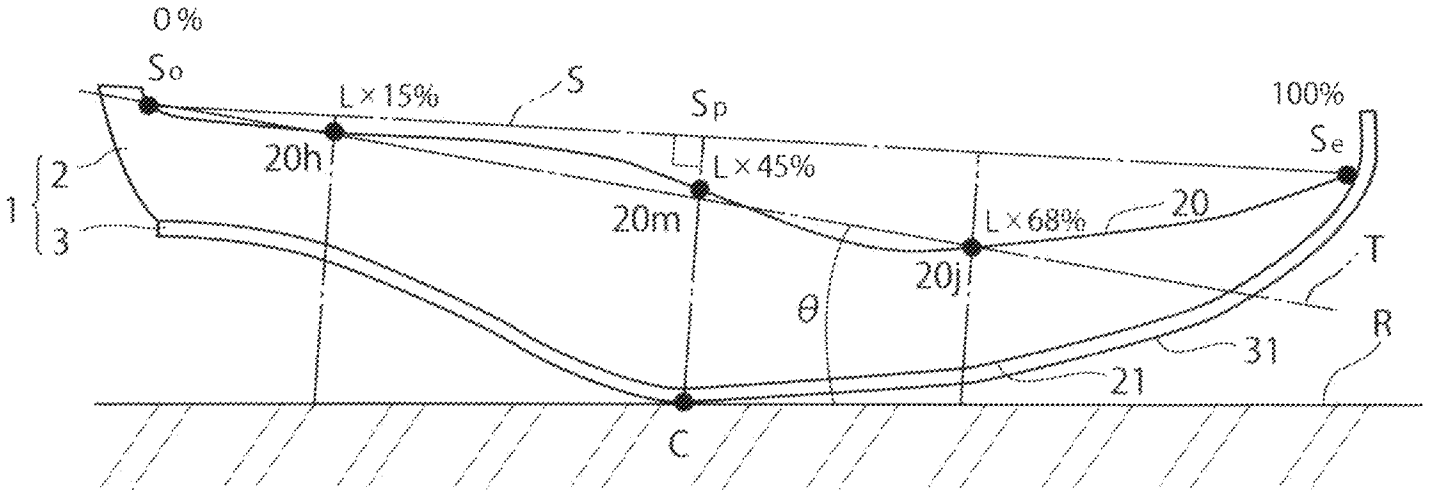
FIG. 5 is a side view of the sole of FIG. 4, showing the details of the shape of the sole.

Also, as shown in FIG. 5, in the reference posture, an inequality, θ≥5 is satisfied, wherein an angle (acute angle) between a straight-line T connecting the heel central position 20*h* of (0.15×L) from the origin O with the metatarsophalangeal joints position 20*j* of (0.68×L) from the origin O and the ground R is set to 0.

Furthermore, as shown in FIG. 5, in the reference posture, the sole bottom surface 31 is preferably separated from the ground at a rearward region from the heel central position 20*h* of (0.15×L) from the origin O along the sole upper surface 20 and at a forward region from the metatarsophalangeal joints position 20*j* of (0.68×L) from the origin O along the sole upper surface 20. More preferably, the sole bottom surface 31 is separated from the ground at a rearward region from the position of (0.25×L) from the origin O along the sole upper surface 20 and at a forward region from the position of (0.60×L) from the origin O along the sole upper surface 20.

Figure 6:
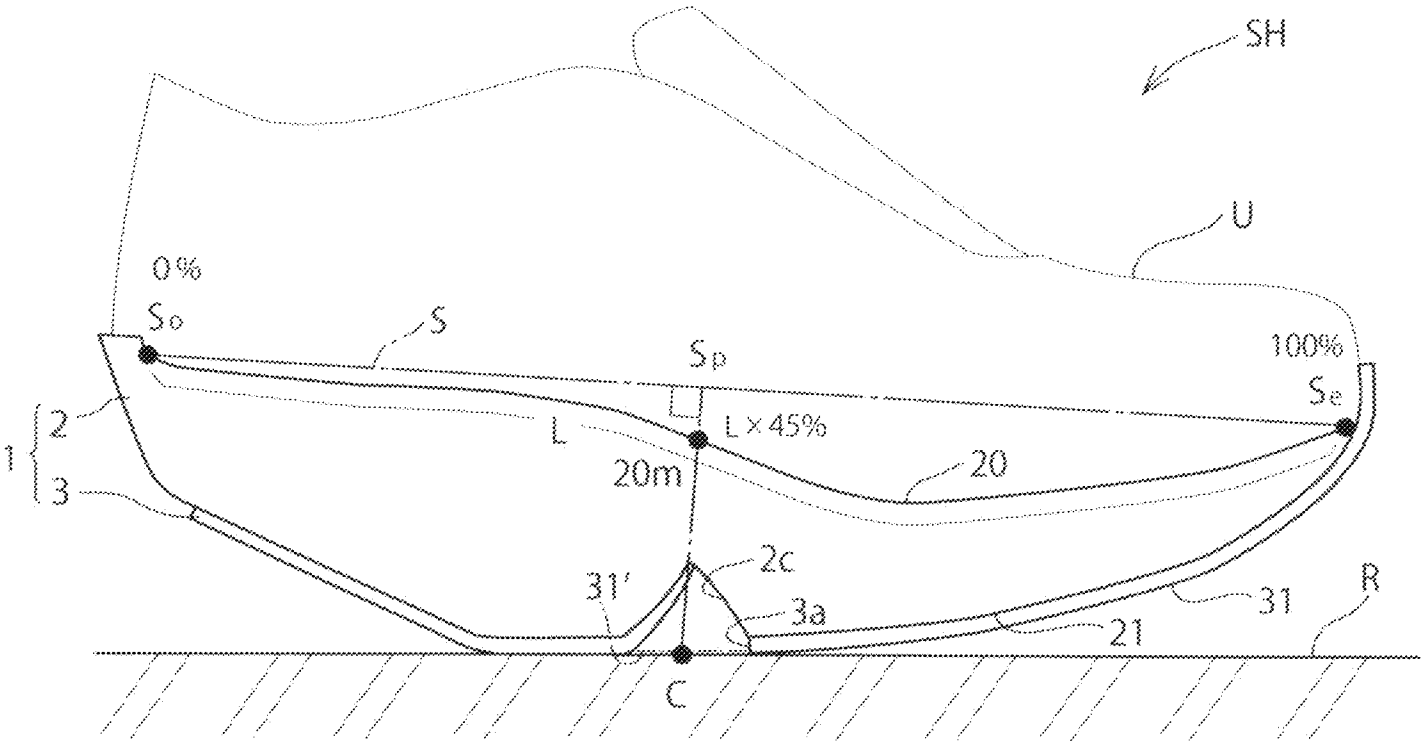
FIG. 6 is a side schematic view of a shoe incorporating a sole with a bottom surface shape different from that of the sole of FIG. 4.

In FIGS. 4 and 5, an example is shown in which the point C actually exists on the sole bottom surface 31. In contrast, as shown in FIGS. 6 and 7, in the event that the outsole 3 has a through hole (or concave portion) 3*a* formed thereon at the position corresponding to the position C (in the respective drawings, the midsole 2 also has a concave portion 2*c*), a virtual surface that is formed by smoothly connecting the opening edges of the through hole 3*a* longitudinally along the sole bottom surface (i.e. the bottom surface 31 of the outsole 3) is defined as a virtual sole bottom surface 31', and an intersection point of the virtual sole bottom surface 31' and a line crossing the position 20*m* and orthogonal to the reference line S is set to the point C.

Figure 7:
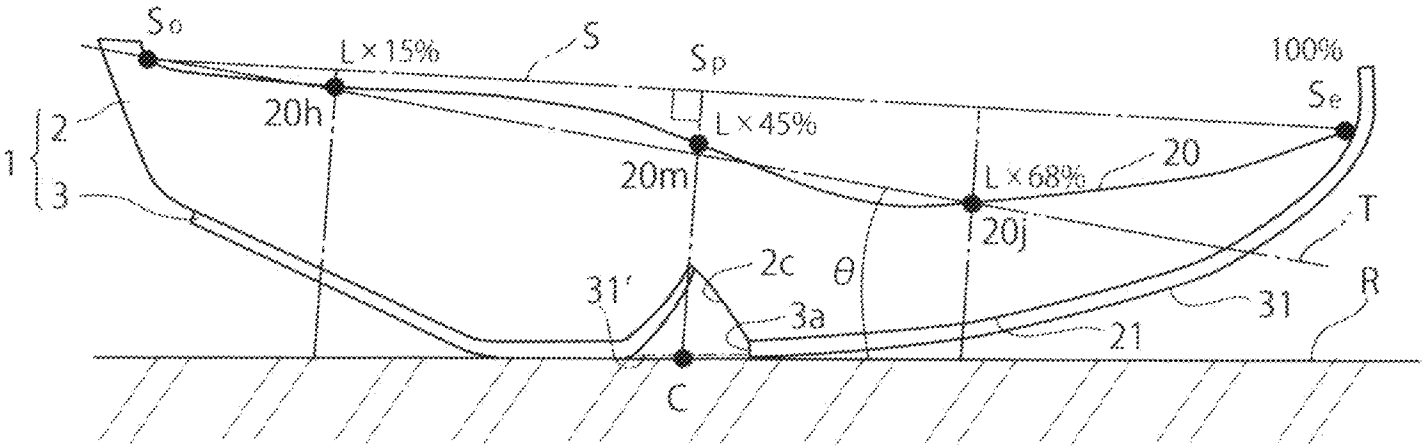
FIG. 7 is a side view of the sole of FIG. 6, showing the details of the shape of the sole.

In this case as well, as shown in FIG. 7, an inequality, 0≥5 is satisfied in the reference posture, wherein an angle (acute angle) between a straight line T connecting the heel central position 20*h* of (0.15×L) from the origin O with the metatarsophalangeal joints position 20*j* of (0.68×L) from the origin O and the ground R is set to 0.

Moreover, as shown in FIG. 7, in the reference posture, the sole bottom surface 31 is preferably separated from the ground at a rearward region from the heel central position 20*h* of (0.15×L) from the origin O along the sole upper surface 20 and at a forward region from the metatarsophalangeal joints position 20*j* of (0.68×L) from the origin O along the sole upper surface 20. More preferably, the sole bottom surface 31 is separated from the ground at a rearward region from the position of (0.25×L) from the origin O along the sole upper surface 20 and at a forward region from the position of (0.60×L) from the origin O along the sole upper surface 20.

Here, the heel portion, a midfoot portion and a forefoot portion of the sole 1 are designated as follows by using a path length L measured along the sole top surface 20 from the origin O to the toe-tip end position Se:

i) Heel portion: 0 to (0.25×L)

ii) Midfoot portion: (0.25×L) to (0.60×L)

iii) Forefoot portion: (0.60×L) to (1.00×L)

Then, effects of the present embodiment will be explained using FIG. 8 in reference to FIGS. 4 and 5.

FIG. 8(*a*) shows the sole 1 in a phase of a ground-contact with the ground R. At this juncture, the sole 1 maintains the reference posture in which the sole 1 is in contact with the ground R at the point C (FIGS. 4 and 5).

As mentioned above, in the reference posture in which sole 1 is in contact with the ground R at the point C (FIGS. 4 and 5), at the heel portion (preferably, in FIGS. 4 and 5, in a rearward region from the heel central position 20*h* of (0.15×L) from the origin O) and the toe portion (preferably, in FIGS. 4 and 5, in a forward region from the metatarsophalangeal joints position 20*j* of (0.68×L) from the origin O), the sole bottom surface 31 is separated (or floated) from the ground R. Thereby, an unintentional ground contact of the heel portion can be prevented and a natural forefoot running can be urged and sustainable.

Also, in the reference posture, as stated above, the inequality, θ>5 is satisfied, wherein the angle between the straight-line T connecting the heel central position 20*h* of (0.15×L) from the origin O with the metatarsophalangeal joints position 20*j* of (0.68×L) from the origin O and the ground R is set to 0 as shown in FIG. 5. Thereby, the heel portion of the sole 1 is disposed above the forefoot portion (that is, the sole 1 is placed in a heel-up posture), thus coinciding with the forefoot running posture.

FIG. 8(*b*) shows the sole 1 in a phase immediately after the ground contact with the ground R. At this juncture, as shown in FIG. 8(*b*), the heel portion of the sole 1 sinks (or falls) down a distance of d toward the ground R, but the sole 1 is placed in the reference posture (see FIG. 8(*a*)) in which the sole 1 is in contact with the ground R at the point C of (0.45×L) from the origin O in front of the foot ankle at the time of impacting the ground. Thereby, not only a natural support effect can be developed by the sole bottom surface 31 from the moment of the ground contact but also a shoe wearer can conduct springy behaviors of tendons of the foot. In such a way, an excessive sinking of the heel portion can be prevented to lessen the amount of sinking/drop d, thus relieving a load to the shoe wearer to improve a running efficiency.

As a result, after the ground contact of the sole 1, the distance to lift up the heel portion can be shortened, thus promptly moving onto the phase of a heel-lift-up shown in FIG. 8(*c*) (in the drawing, a reference character u designates the amount of a heel-lift-up). In such a manner, a transfer from the heel portion to the forefoot portion after impacting the ground can be conducted smoothly and a smooth shift in center of gravity from the heel portion to the toe portion can be achieved.

FIG. 8(*d*) shows the sole 1 in a phase immediately after a push-off motion of the toe portion, in which the shoe SH leaves the ground R.

Here, for comparison purposes, FIG. 9 shows the state of running of a conventional shoe. In FIG. 9, similar to FIG. 8, the motions of the shoe relative to the ground are shown in the order of (a) to (d) in time-series manner. The respective phases (a) to (d) of FIG. 9 correspond to the respective phases (a) to (d) of FIG. 8. Also, in FIG. 9, like reference numbers indicate identical or functionally similar elements to those in FIG. 8.

FIG. 9(*a*) shows the sole 1' in a phase of a ground-contact with the ground R. In FIG. 9(*a*), for comparison with the current embodiment, the sole bottom surface 31' is in contact with the ground R at the midfoot portion or the forefoot portion.

FIG. 9(*b*) shows the sole 1' in a phase immediately after the ground contact with the ground R. At this juncture, as shown in FIG. 9(*b*), the heel portion of the sole 1' sinks (or falls) down a distance of d' toward the ground R, but d'>d. That is, the amount of sinking/drop d' of the heel portion is greater than the amount of sinking/drop d (FIG. 8(*b*)) of the current embodiment.

The reasons for this are given as follows:

In the case of the present embodiment, as above-mentioned, when coming into contact with the ground, the sole 1 is in the reference posture where the sole 1 contacts the ground R at the point C (see FIGS. 4 and 5) of (0.45×L) from the origin O in front of the foot ankle. At this time, the sole bottom surface 31 is separated from the ground R at the heel portion and the toe portion (see FIGS. 4 and 5), and the inequality, θ≥5 is satisfied (see FIG. 5), wherein the angle (acute angle) between the straight line T connecting the heel central position of (0.15×L) from the origin O with the metatarsophalangeal joints position of (0.68×L) from the origin O and the ground R is set to θ. Accordingly, not only a natural support effect by the sole bottom surface 31 can be developed from the time of a ground contact but also a shoe wearer can conduct springy behaviors of tendons of the foot, thus preventing an excessive sinking of the heel portion to lessen the amount of sinking d. To the contrary, in the case of a conventional shoe, it does not have a sole shape based on such a reference posture, and as a result of this, an excessive sinking of the heel portion immediately after a ground contact cannot be restricted.

FIG. 9(*c*) shows the sole in a phase of a heel-lift-up after the ground contact. In this case, since the amount of sinking d' of the heel portion is large in the phase of FIG. 9(*b*), the amount of lift-up u' of the heel portion becomes large (u'>u), such that thereby a smooth transfer from the phase of FIG. 9(*b*) to the heel-lift-up phase of FIG. 9(*c*) cannot be achieved. As a result, a transfer from the heel portion to the forefoot portion after impacting the ground cannot be performed in a smooth manner and a smooth shift in center of gravity from the heel portion to the toe portion cannot be achieved. Also, as the amount of sinking d' of the heel portion becomes large, a shoe wearer has a heavy load and thus a running efficiency cannot be improved. In contrast, according to the present embodiment, by conducting springy behaviors of tendons of the foot, an excessive sinking of the heel portion can be prevented to lessen the amount of sinking d, thus decreasing a load of a shoe wearer to improve running efficiency.

FIG. 9(*d*) shows the sole in a phase immediately after a push-off motion of the toe portion of the shoe SH, in which the shoe SH' is separated from the ground R.

Figure 10:
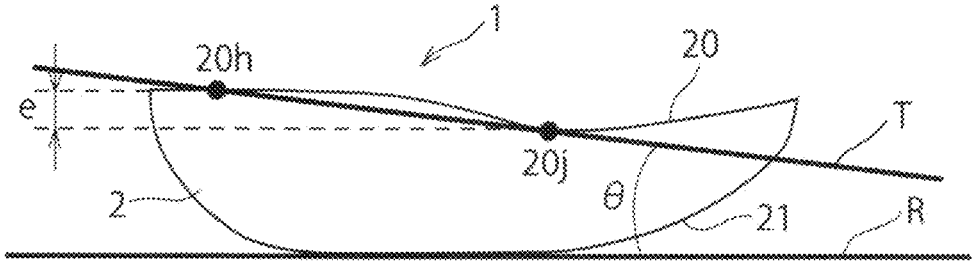
FIG. 10 is a side schematic view of a sole according to a first alternative embodiment of the present invention, showing an unloaded state.
Figure 11:
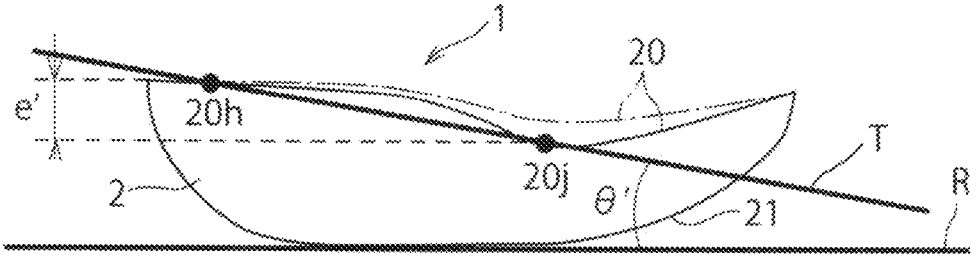
FIG. 11 is a side schematic view of the sole of FIG. 10, showing a loaded state.

Then, FIGS. 10 and 11 respectively show the states of unloading and loading of the sole according to a first alternative embodiment of the present invention. In these drawings, like reference numbers indicate identical or functionally similar elements to those in the above-mentioned embodiment. Additionally, in the respective drawings, the outsole 3 in the above-mentioned embodiment is omitted for illustration purposes.

In the above-mentioned embodiment, an example was shown in which the midsole 2 has substantially the same compressive rigidity from the heel portion to the toe portion along the entire length of the midsole 2, but in this first alternative embodiment, the compressive rigidity of the midsole 2 is lower at the forefoot region and higher at the midfoot portion and the heel portion at the rear of the forefoot region. Preferably, the compressive rigidity of the midsole 2 is lower at the metatarsophalangeal joints position 20*j* and higher at the heel portion. The term, "compressive rigidity" means a resistance to deformation relative to a compressive load. When the same compressive load is applied, a sole of a high compressive rigidity undergoes a small amount of deformation, and a sole of a low compressive rigidity undergoes a large amount of deformation. Therefore, the midsole 2 is softer on the side of the forefoot portion (preferably, at the metatarsophalangeal joints position 20*j*) and harder on the side of the midfoot portion and the heel portion. As a method of causing the forefoot portion of the midsole 2 to be relatively less compressive rigidity, for example, the expansion ratio of a foaming material is made relatively higher at the forefoot region, a multiple of holes are formed on the forefoot region, and so on.

When the compressive load is imparted to the sole 1 from the unloaded state shown in FIG. 10, as shown in FIG. 11, the forefoot portion of the midsole 2 deforms (or compression-deforms) more largely downwardly than the midfoot portion and the heel portion, such that thereby the sole top surface 20 falls relatively more largely downwardly on the side of the forefoot portion (in the drawing, a dash-and-dot line indicates the unloaded state of FIG. 10). As a result, a vertical distance between the heel central position 20*h* and the metatarsophalangeal joints position 20*j* changes into e' from e (<e') shown in FIG. 10, and the angle between the straight-line T connecting the heel central position 20*h* with the metatarsophalangeal joints position 20*j* and the ground R changes into θ' from θ (<θ') shown in FIG. 10.

Thereby, a support angle relative to the foot of the shoe wearer becomes large, thus preventing an excessive drop of the heel portion after making a sole contact with the ground to allow for a smooth forward weight shift.

Figure 12:
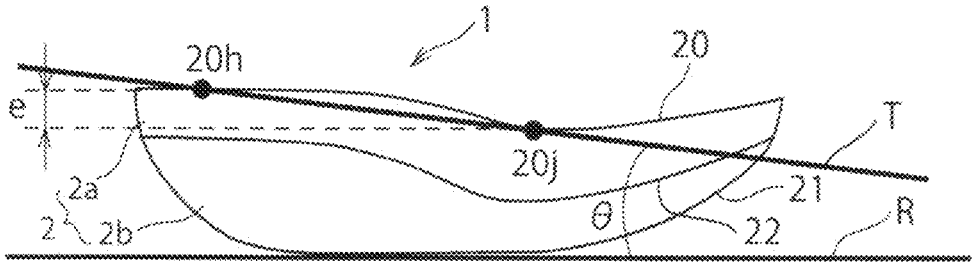
FIG. 12 is a side schematic view of a sole according to a second alternative embodiment of the present invention, showing an unloaded state.
Figure 13:
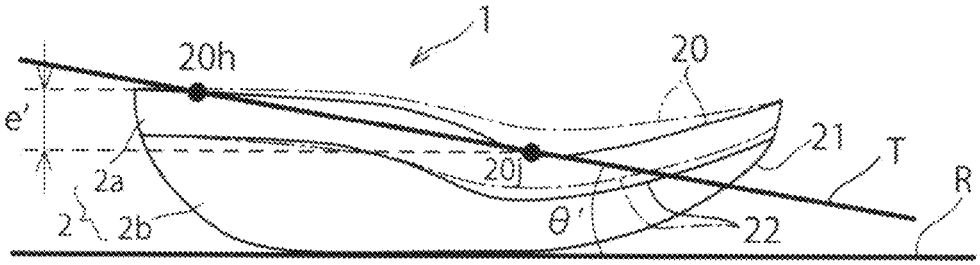
FIG. 13 is a side schematic view of the sole of FIG. 12, showing a loaded state.

Then, FIGS. 12 and 13 respectively show the states of unloading and loading of the sole according to a second alternative embodiment of the present invention. In these drawings, like reference numbers indicate identical or functionally similar elements to those in the above-mentioned embodiment and the first alternative embodiment. In the respective drawings, the outsole 3 in the above-mentioned embodiment is omitted for illustration purposes.

In the above-mentioned embodiment, an example was shown in which the midsole 2 is formed of a single-layered midsole and has substantially the same compressive rigidity from the heel portion to the toe portion along the entire length, but in this second alternative embodiment, the midsole 2 includes an upper midsole 2*a* disposed on the upper side thereof and a lower midsole 2*b* disposed on the lower side thereof, the upper and lower midsoles 2*a*, 2*b* being bonded or fixedly attached to one another at the respective boundary surfaces 22. Also, in the second alternative embodiment, the compressive rigidity of the upper midsole 2*a* is lower at the forefoot portion (preferably, the metatarsophalangeal joints position 20*j*) and higher at the midfoot portion and the heel portion at the rear of the forefoot portion, and the compressive rigidity of the lower midsole 2*b* is substantially the same as the compressive rigidity of the midfoot portion and the heel portion of the upper midsole 2*a* along the entire length of the lower midsole 2*b*. Therefore, the upper midsole 2*a* is relatively softer on the side of the forefoot portion and relatively harder on the side of the midfoot portion and the heel portion.

When the compressive load is imparted to the sole 1 from the unloaded state shown in FIG. 12, as shown in FIG. 13, the forefoot portion of the upper midsole 2*a* deforms (or compression-deforms) more largely downwardly than the midfoot portion and the heel portion, such that thereby the sole top surface 20 falls relatively more largely downwardly on the side of the forefoot portion (in the drawing, a dash-and-dot line indicates the unloaded state of FIG. 12). As a result, a vertical distance between the heel central position 20*h* and the metatarsophalangeal joints position 20*j* changes into e' from e (<e') shown in FIG. 10, and the angle between the straight-line T connecting the heel central position 20*h* with the metatarsophalangeal joints position 20*j* and the ground R changes into θ' from θ (<θ') shown in FIG. 12.

Thereby, a support angle relative to the foot of the shoe wearer becomes large, thus preventing an excessive drop of the heel portion after making a sole contact with the ground to allow for a smooth forward weight shift.

Figure 14:
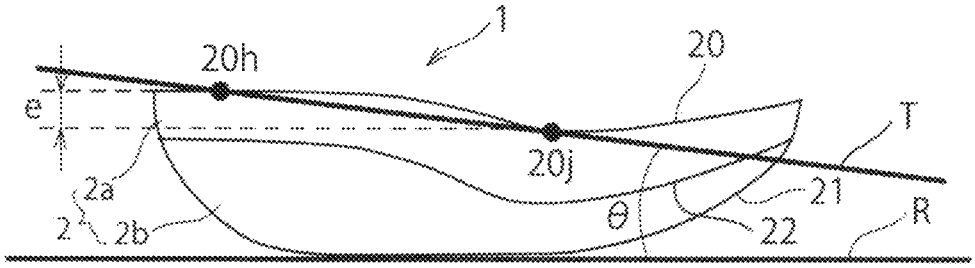
FIG. 14 is a side schematic view of a sole according to a third alternative embodiment of the present invention, showing an unloaded state.
Figure 15:
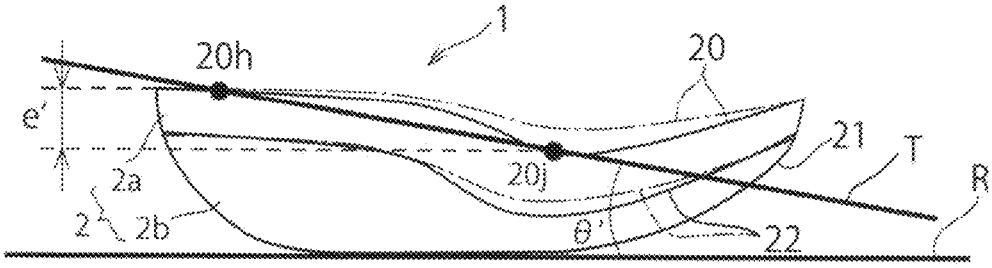
FIG. 15 is a side schematic view of the sole of FIG. 14, showing a loaded state.

Then, FIGS. 14 and 15 respectively show the states of unloading and loading of the sole according to a third alternative embodiment of the present invention. In these drawings, like reference numbers indicate identical or functionally similar elements to those in the above-mentioned embodiment and the first to second alternative embodiments. In the respective drawings, the outsole 3 in the above-mentioned embodiment is omitted for illustration purposes.

In the above-mentioned embodiment, an example was shown in which the midsole 2 is formed of a single-layered midsole and has substantially the same compressive rigidity from the heel portion to the toe portion along the entire length, but in this third alternative embodiment, the midsole 2 includes an upper midsole 2*a* disposed on the upper side thereof and a lower midsole 2*b* disposed on the lower side thereof, the upper and lower midsoles 2*a*, 2*b* being bonded or fixedly attached to one another at the respective boundary surfaces 22. Also, in the third alternative embodiment, the compressive rigidity of the lower midsole 2*b* is lower at the forefoot portion (preferably, a lower position corresponding to the metatarsophalangeal joints position 20*j*) and higher at the midfoot portion and the heel portion at the rear of the forefoot portion, and the compressive rigidity of the upper midsole 2*a* is substantially the same as the compressive rigidity of the midfoot portion and the heel portion of the lower midsole 2*b* along the entire length of the upper midsole 2*a*. Therefore, the lower midsole 2*b* is relatively softer on the side of the forefoot portion and relatively harder on the side of the midfoot portion and the heel portion.

When the compressive load is imparted to the sole 1 from the unloaded state shown in FIG. 14, as shown in FIG. 15, the forefoot portion of the lower midsole 2*b* deforms (or compression-deforms) more largely downwardly than the midfoot portion and the heel portion, such that thereby the sole top surface 20 falls relatively more largely downwardly on the side of the forefoot portion (in the drawing, a dash-and-dot line indicates the unloaded state of FIG. 14). As a result, a vertical distance between the heel central position 20*h* and the metatarsophalangeal joints position 20*j* changes into e' from e (<e') shown in FIG. 14, and the angle between the straight line T connecting the heel central position 20*h* with the metatarsophalangeal joints position 20*j* and the ground R changes into θ' from θ (<θ') shown in FIG. 14.

Thereby, a support angle relative to the foot of the shoe wearer becomes large, thus preventing an excessive drop of the heel portion after making a sole contact with the ground to allow for a smooth forward weight shift.

Figure 16:
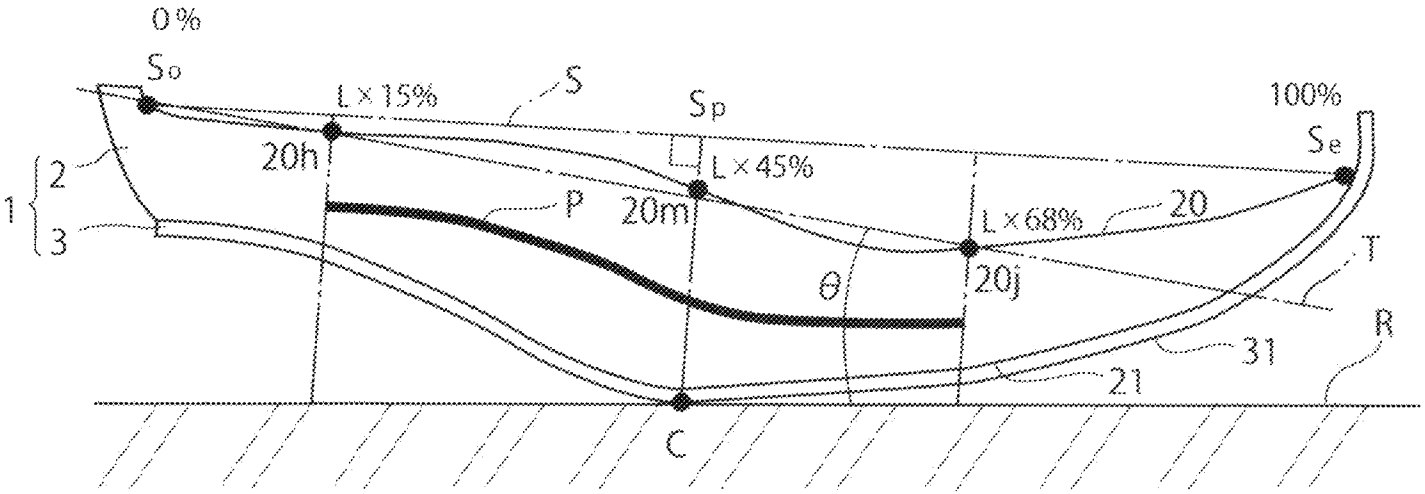
FIG. 16 is a side schematic view of a sole according to a fourth alternative embodiment of the present invention, corresponding to FIG. 5 of the above-mentioned embodiment.
Figure 17:
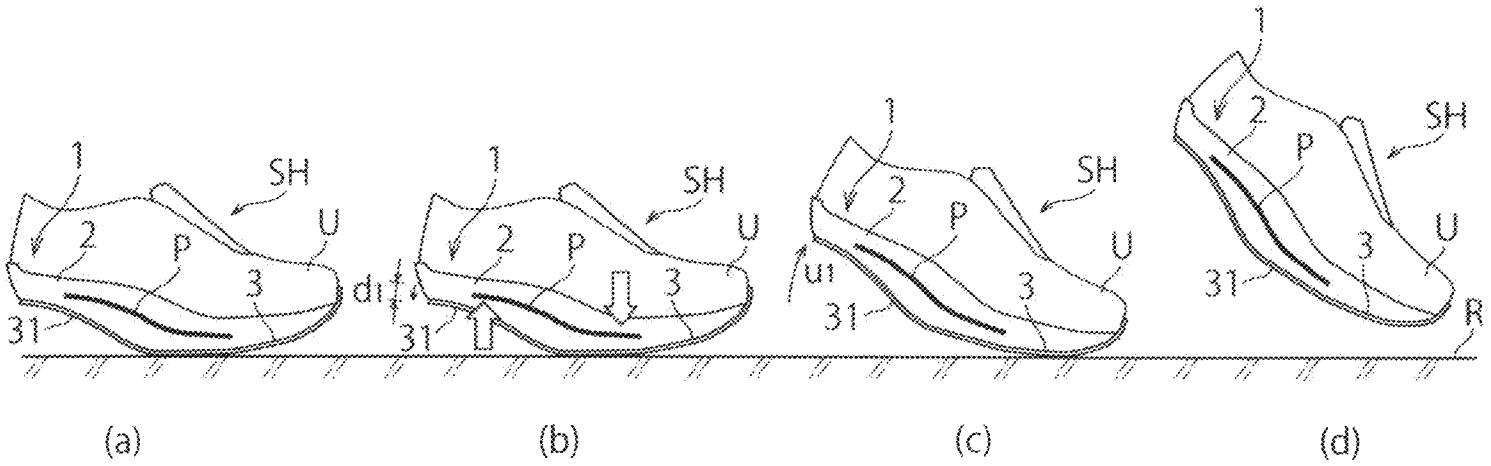
FIG. 17 shows the state of running of the shoe that employs the sole of FIG. 16, illustrating movements of the shoe relative to the ground in the order from (a) to (d) in time-series manner.

FIGS. 16 and 17 show a sole according to a fourth alternative embodiment of the present invention. FIG. 16 illustrates a side surface shape of the sole, and FIG. 17 illustrates the state of running of the shoe in time-series manner. In the respective drawings, like reference numbers indicate identical or functionally similar elements to those in the above-mentioned embodiment and the first alternative embodiment.

As shown in FIG. 16, the midsole 2 of the sole 1 has a curved plate P incorporated therein. Here, for illustration purposes, the curved plate P is shown in a thick line. In this example, a side surface of the curved plate P is seen at a side surface of the midsole 2, but unlike that, the curved plate P may be built in the midsole 2 such that the side surface of the curved plate P is not seen at the side surface of the midsole 2.

As shown in FIG. 16, the curved plate P extends curvedly and longitudinally starting from the heel central position 20*h* of (0.15×L) from the origin O and terminating at the metatarsophalangeal joints position 20*j* of (0.68×L) from the origin O. That is, the curved plate P extends from the position 20*h* toward the front side nearly linearly or curvedly in a slightly upward convex shape in a gently diagonally downward direction. The curved plate P further extends forwardly and at the position 20*m* or in the vicinity thereof, changes into a downward convex shape and extends nearly linearly in a forward direction toward the position 20*j*. The curved plate P has an elasticity in the vertical direction.

The curved plate P is a thin, sheet-like member and its thickness is, for example, approximately, 1 to 2 mm. The curved plate P may be incorporated in the sole 2 through such as, but not limited to an insert molding. In the event that the midsole 2 is formed of two-layered midsole of the upper and lower midsoles, the curved plate P may be attached adhesively at boundary surfaces of the respective midsoles.

The curved plate P may be formed of thermoplastic resin comparatively rich in elasticity such as thermo plastic polyurethane (TPU), polyamide elastomer (PAE), acrylonitrile butadiene styrene resin (ABS) and the like, alternatively, thermosetting resin such as epoxy resin, unsaturated polyester resin and the like. Also, as a material for the curved plate P, fiber reinforced plastics (FRP) may be adopted in which carbon fibers, aramid fibers, glass fibers or the like are incorporated as a strengthened fiber, and thermosetting resin or thermoplastic resin is incorporated as matrix resin.

Then, effects of the fourth alternative embodiment of the present invention will be explained using FIG. 17 in reference to FIG. 16.

FIG. 17(*a*) shows the sole 1 in a phase of a ground-contact with the ground R. At this juncture, the sole 1 maintains the reference posture in which sole 1 is in contact with the ground R at the point C (FIG. 16).

In the reference posture in which sole 1 is in contact with the ground R at the point C (FIG. 16), at the heel portion (preferably, in FIG. 16, in a rearward region from the heel central position 20*h* of (0.15×L) from the origin O) and the toe portion (preferably, in FIG. 16, in a forward region from the metatarsophalangeal joints position 20*j* of (0.68×L) from the origin O), the sole bottom surface 31 is separated (or floated) from the ground R. Thereby, an unintentional ground contact of the heel portion can be prevented and a natural forefoot running can be urged and sustainable.

Also, in the reference posture, an inequality, θ>5 is satisfied, wherein an angle between the straight-line T connecting the heel central position 20*h* of (0.15×L) from the origin O with the metatarsophalangeal joints position 20*j* of (0.68×L) from the origin O and the ground R is set to θ as shown in FIG. 16. Thereby, the heel portion of the sole 1 is disposed above the forefoot portion (that is, the sole 1 is placed in a heel-up posture), thus coinciding with the forefoot running posture.

FIG. 17(*b*) shows the sole 1 in a phase immediately after the ground contact with the ground R. At this juncture, as shown in FIG. 17(*b*), the heel portion of the sole 1 sinks (or falls) down a distance of $d_1$ toward the ground R, but the sole 1 is placed in the reference posture (see FIG. 17(*a*)) in which the sole 1 is in contact with the ground R at the point C (see FIG. 16) of (0.45×L) from the origin O in front of the foot ankle at the time of impacting the ground. Thereby, not only a natural support effect can be developed by the sole bottom surface 31 from the moment of the ground contact but also a shoe wearer can conduct springy behaviors of tendons of the foot. In such a way, an excessive sinking of the heel portion can be prevented to lessen the amount of sinking/drop $d_1$, thus relieving a load to the shoe wearer to improve a running efficiency.

Moreover, in this case, the curved plate P provided inside the midsole 2 can support a load imparted to the heel portion of the sole 1 and thus springy behaviors of tendons of the foot can be advantaged. Thereby, the amount of drop $d_1$ of the heel portion can be further decreased (that is, $d_1<d$ (see FIG. 8)), thus further relieving the load to the shoe wearer to further improve a running efficiency.

As a result, after the ground contact of the sole 1, the distance to lift up the heel portion can be shortened, thus promptly moving onto the phase of a heel-lift-up shown in FIG. 17(*c*). In the drawing, a reference character $u_1$ designates the amount of a heel-lift-up and $u_1<u$ (see FIG. 8)). Also, at the time of weight shift from FIG. 17(*b*) to FIG. 17(*c*), a load is imparted to a distal end side of the curved plate P (that is, a shoe wearer steps on the distal end side of the curved plate P), thereby through a seesaw action the other end side of the curved plate P is lifted upwardly (see void arrows in FIG. 17(*b*)), thus promptly preventing a drop of the heel portion. In such a manner, a transfer from the heel portion to the forefoot portion after impacting the ground can be conducted smoothly and a smooth shift in center of gravity from the heel portion to the toe portion can be achieved.

FIG. 17(*d*) shows the sole 1 in a phase immediately after a push-off motion of the toe portion, in which the shoe SH leaves the ground R.

Figure 18:
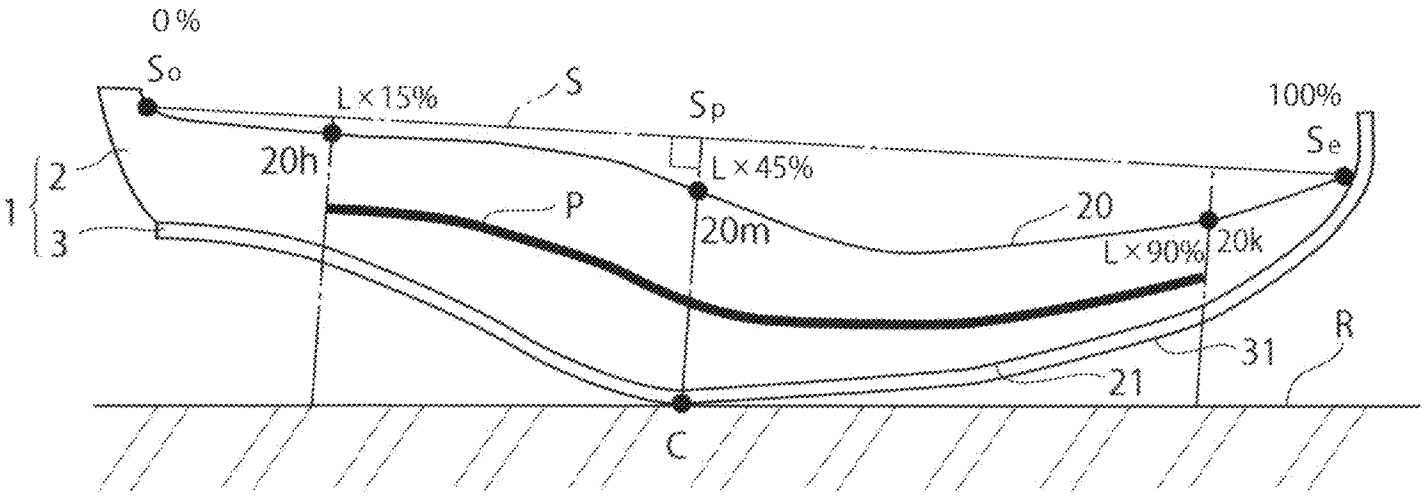
FIG. 18 is a side schematic view of a sole according to a fifth alternative embodiment of the present invention, corresponding to FIG. 5 of the above-mentioned embodiment.
Figure 19:
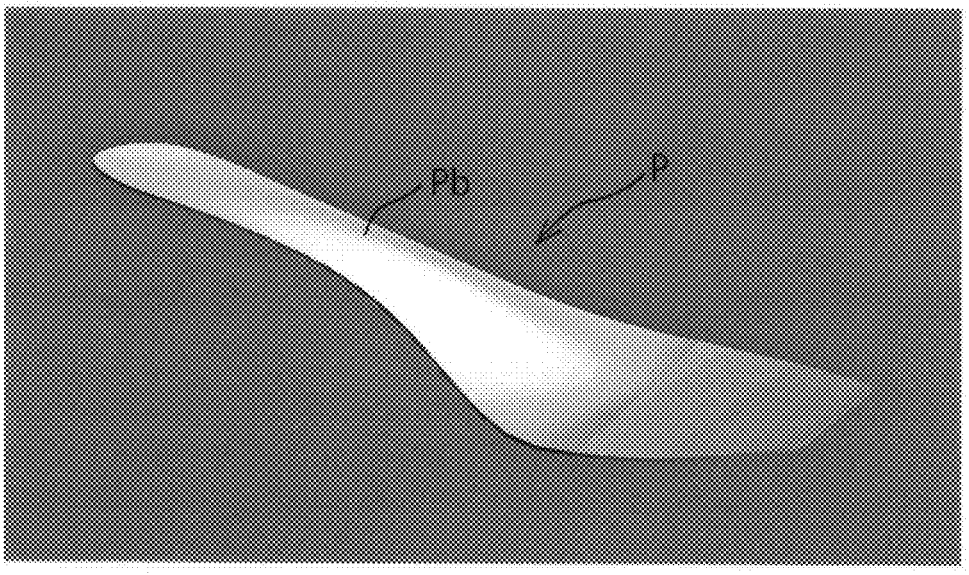
FIG. 19 is a general perspective view of a curved plate provided in the sole of FIG. 18, as viewed from forwardly diagonally above.
Figure 20:
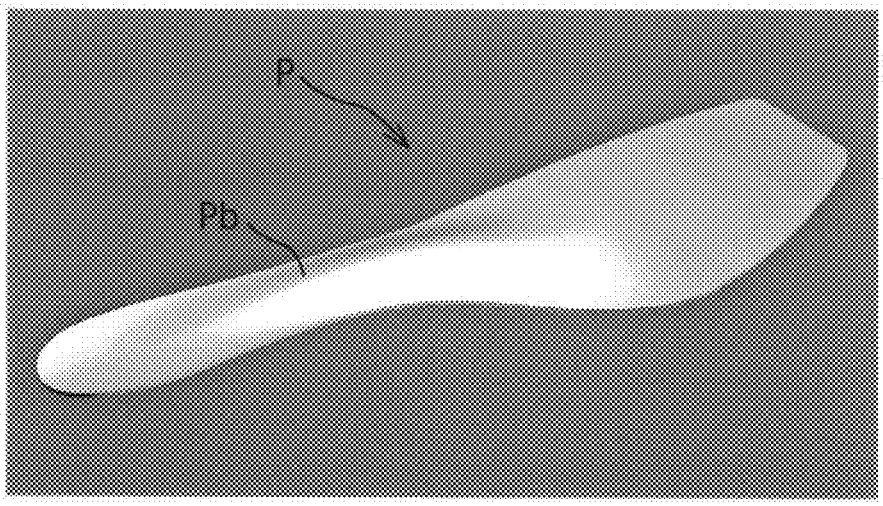
FIG. 20 is a general perspective view of the curved plate of FIG. 19, as viewed from rearwardly diagonally above.
Figure 21:
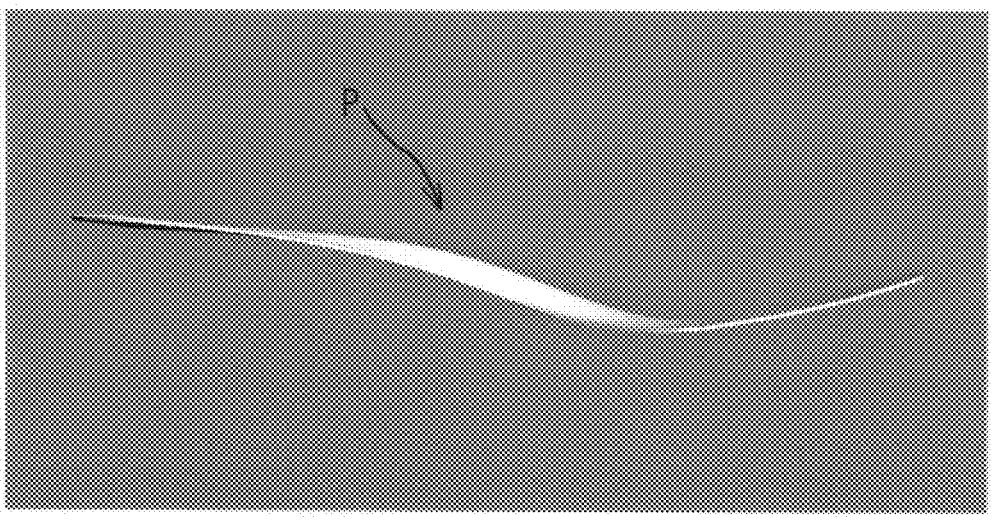
FIG. 21 is a side view of the curved plate of FIG. 19.
Figure 22:
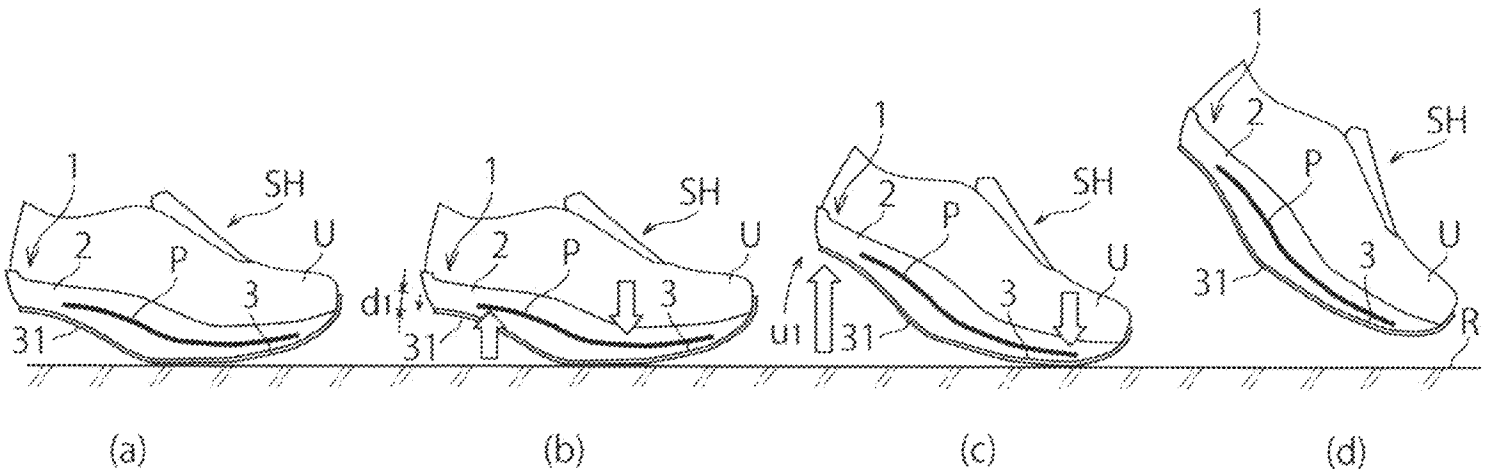
FIG. 22 shows the state of running of the shoe that employs the sole of FIG. 18, illustrating movements of the shoe relative to the ground in the order from (a) to (d) in time-series manner.

FIGS. 18 to 22 show a sole according to a fifth alternative embodiment of the present invention. FIG. 18 illustrates a side surface shape of the sole, FIGS. 19 to 21 illustrate external views of a curved plate, and FIG. 22 illustrates the state of running of the shoe in time-series manner. In the respective drawings, like reference numbers indicate identical or functionally similar elements to those in the above-mentioned embodiment and the fourth alternative embodiment.

As shown in FIG. 18, the midsole 2 of the sole 1 has a curved plate P incorporated therein. Here, for illustration purposes, the curved plate P is shown in a thick line. In this example, a side surface of the curved plate P is seen at a side surface of the midsole 2, but unlike that, the curved plate P may be built in the midsole 2 such that the side surface of the curved plate P is not seen at the side surface of the midsole 2.

As shown in FIG. 18, the curved plate P extends curvedly and longitudinally starting from the heel central position 20*h* of (0.15×L) from the origin O and terminating at the position 20*k* (or near a toe portion) of (0.90×L) from the origin O. That is, the curved plate P extends from the position 20*h* toward the front side nearly linearly or curvedly in a slightly upward convex shape in a gently diagonally downward direction. The curved plate P further extends forwardly and at the position 20*m* or in the vicinity thereof, changes into a downward convex shape and extends gently curvedly in a downward convex shape in a forward direction toward the position 20*k* (see FIG. 21). The curved plate P has an elasticity in the vertical direction.

The curved plate P is a thin, sheet-like member and its thickness is, for example, approximately, 1 to 2 mm. The curved plate P may be incorporated in the sole 2 through such as, but not limited to an insert molding. In the event that the midsole 2 is formed of two-layered midsole of the upper and lower midsoles, the curved plate P may be attached adhesively at boundary surfaces of the respective midsoles. Also, as shown in FIGS. 19 and 20, the curved plate P may have a ridge portion (or rib) Pb at a laterally and longitudinally central portion, which is upwardly raised in a crest-shape and extends longitudinally.

Then, effects of the fifth alternative embodiment of the present invention will be explained using FIG. 22 in reference to FIG. 18.

FIG. 22(*a*) shows the sole 1 in a phase of a ground-contact with the ground R. At this juncture, the sole 1 maintains the reference posture in which the sole 1 is in contact with the ground R at the point C (FIG. 18).

In the reference posture in which the sole 1 is in contact with the ground R at the point C (FIG. 18), at the heel portion (preferably, in FIG. 18, in a rearward region from the heel central position 20*h* of (0.15×L) from the origin O) and the toe portion (preferably, in FIG. 18, in a forward region from the metatarsophalangeal joints position 20*j* of (0.68×L) from the origin O), the sole bottom surface 31 is separated (or floated) from the ground R. Thereby, an unintentional ground contact of the heel portion can be prevented and a natural forefoot running can be urged and sustainable.

Also, in the reference posture, similar to the above-mentioned embodiment and the fourth alternative embodiment, an inequality, $\theta>5$ is satisfied, wherein an angle between the straight-line T connecting the heel central position 20*h* of (0.15×L) from the origin O with the metatarsophalangeal joints position 20*j* of (0.68×L) from the origin O and the ground R is set to 0 (see FIG. 18). Thereby, the heel portion of the sole 1 is disposed above the forefoot portion (that is, the sole 1 is placed in a heel-up posture), thus coinciding with the forefoot running posture.

FIG. 18(*b*) shows the sole 1 in a phase immediately after the ground contact with the ground R. At this juncture, as shown in FIG. 18(*b*), the heel portion of the sole 1 sinks (or falls) down a distance of $d_1$ toward the ground R, but the sole 1 is placed in the reference posture (see FIG. 22(*a*)) in which the sole 1 is in contact with the ground R at the point C (see FIG. 18) of (0.45×L) from the origin O in front of the foot ankle at the time of impacting the ground. Thereby, not only a natural support effect can be developed by the sole bottom surface 31 from the moment of the ground contact but also a shoe wearer can conduct springy behaviors of tendons of the foot. In such a way, an excessive sinking or drop of the heel portion can be prevented to lessen the amount of sinking/drop $d_1$, thus relieving a load to the shoe wearer to improve a running efficiency.

Moreover, in this case, the curved plate P provided inside the midsole 2 can support a load imparted to the heel portion of the sole 1 and thus springy behaviors of tendons of the foot can be advantaged. Thereby, the amount of drop $d_1$ of the heel portion can be further decreased (that is, $d_1<d$ (see FIG. 8)), thus further relieving the load to the shoe wearer to further improve a running efficiency. Moreover, the curved plate P has a ridge portion Pb, which increases a rigidity of the curved plate P, thus still further decreasing the amount of drop $d_1$ of the heel portion.

As a result, after the ground contact of the sole 1, the distance to lift up the heel portion can be shortened, thus promptly moving onto the phase of a heel-lift-up shown in FIG. 22(*c*). In the drawing, a reference character $u_1$ designates the amount of a heel-lift-up ($u_1<u$ (see FIG. 8)). Also, at the time of weight shift from FIG. 22(*b*) to FIG. 22(*c*), as a load is imparted to a distal end (or toe) side of the curved plate P (that is, a shoe wearer steps on the distal end side of the curved plate P), through a seesaw action the other end side of the curved plate P is lifted upwardly (see void arrows in FIG. 22(*b*)), thus promptly preventing a drop of heel portion. In such a manner, a transfer from the heel portion to the forefoot portion after impacting the ground can be conducted smoothly and a smooth shift in center of gravity from the heel portion to the toe portion can be achieved.

Also, in the phase of FIG. 22(*c*), as the load is imparted to the distal end side of the curved plate P (that is, the shoe wearer steps on the distal (or front) end side of the curved plate P), through a further seesaw action, the other (or rear) end side of the curved plate P is lifted further upwardly (see void arrows in FIG. 22(*c*)), thereby promoting elevation of the heel portion to allow for supporting a forward drive.

FIG. 22(*d*) shows the sole 1 in a phase immediately after a push-off motion of the toe portion, in which the shoe SH leaves the ground R. In this case, sine the curved plate P extends to the vicinity of the toe portion, at the time of push-off motion of the toe-tip portion, through an elastic repulsion of the curved plate P, a shoe wearer can strongly strike the ground R to obtain a propulsion power.

As mentioned above, the present invention is useful for a sole for a shoe that can naturally urge a forefoot running during running, that can make it sustainable, and that can enhance a running efficiency during forefoot running.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole for a shoe, said sole extending from a heel portion to a toe portion and having a sole upper surface and a sole lower surface, wherein a reference line is set as a straight line to connect a toe-tip position and a rearmost end position of said sole upper surface, said rearmost end position is set to the origin, a path length measured along said sole upper surface from the origin to said toe-tip position is set to L, and an intersection point is set as a point where a line passing a position of (0.45×L) from the origin along said sole upper surface and crossing said reference line at a right angle intersects said sole lower surface at said intersection point;

wherein a sole reference posture is defined as a sole posture in which said sole is in contact with the ground at said intersection point;

wherein said sole lower surface is separated from the ground at the heel portion and the toe portion in said sole reference posture;

wherein when an angle θ is set as an angle between the ground and a straight line connecting a heel central position of (0.15×L) along said sole upper surface from the origin with a metatarsophalangeal joints position of (0.68×L) along said sole upper surface from the origin, said angle θ is greater than or equal to 5 degrees in said sole reference posture;

wherein said position of (0.45×L) from the origin along said sole upper surface is configured and adapted to be disposed in front of an ankle of a wearer of the shoe; and wherein said sole lower surface has a downwardly convexly curved shape at said intersection point.

2. The sole according to claim 1, wherein in said sole reference posture, said sole lower surface is separated from the ground in a rear side region from said heel central position along said sole upper surface and in a foreside region from said metatarsophalangeal joints position along said sole upper surface.

3. The sole according to claim 1, wherein a compressive rigidity at said metatarsophalangeal joints position is lower than a compressive rigidity at said heel portion.

4. The sole according to claim 1 further comprising a curved plate provided in said sole and extending continuously curvedly, wherein said curved plate extends at least at said heel central position and said metatarsophalangeal joints position.

* * * * *